US010988272B2

(12) United States Patent
Nakamura

(10) Patent No.: US 10,988,272 B2
(45) Date of Patent: Apr. 27, 2021

(54) PACKAGING MACHINE

(71) Applicant: ISHIDA CO., LTD., Kyoto (JP)

(72) Inventor: Kazunori Nakamura, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 127 days.

(21) Appl. No.: 16/095,684

(22) PCT Filed: Mar. 6, 2017

(86) PCT No.: PCT/JP2017/008673
§ 371 (c)(1),
(2) Date: Oct. 22, 2018

(87) PCT Pub. No.: WO2017/187788
PCT Pub. Date: Nov. 2, 2017

(65) Prior Publication Data

US 2019/0152638 A1 May 23, 2019

(30) Foreign Application Priority Data

Apr. 28, 2016 (JP) ..... JP2016-090442

(51) Int. Cl.
*B65B 51/26* (2006.01)
*B65B 57/00* (2006.01)
(Continued)

(52) U.S. Cl.
CPC ..... *B65B 51/26* (2013.01); *B65B 9/20* (2013.01); *B65B 57/005* (2013.01); *B65B 59/04* (2013.01)

(58) Field of Classification Search
CPC .. B65B 1/26; B65B 9/20; B65B 7/005; B65B 59/04; B65B 57/18; B65B 51/26; B65B 57/005; B01L 7/32
See application file for complete search history.

(56) References Cited

U.S. PATENT DOCUMENTS 2,934,390 A * 4/1960 Wright ..... B01L 1/50 312/270.3
3,314,210 A * 4/1967 Jarund ..... B67B 7/26 53/449
(Continued)

FOREIGN PATENT DOCUMENTS

DE 19541617 A1 5/1997
DE 102011075379 A1 11/2012
(Continued)

OTHER PUBLICATIONS

Search Report from the corresponding European Patent Application No. 17789077.9 dated Feb. 12, 2019.
(Continued)

*Primary Examiner* — Thomas M Wittenschlaeger
*Assistant Examiner* — Scott A Howell
(74) *Attorney, Agent, or Firm* — Shinjyu Global IP

(57) ABSTRACT

A packaging machine includes a vertical sealing unit, a movable cover, and a linkage mechanism. The vertical sealing unit is provided so as to be retractable from a vertical sealing position for tubular film. The movable cover covers a heated part of the vertical sealing unit. The linkage mechanism transmits a retracting movement of the vertical sealing unit to the cover to thereby cause the cover to move from a position in which it exposes the heated part to a position in which it covers the heated part.

6 Claims, 6 Drawing Sheets

(51) Int. Cl.
*B65B 9/20* (2012.01)
*B65B 59/04* (2006.01)

(56) References Cited

U.S. PATENT DOCUMENTS

| | | | | |
|---|---|---|---|---|
| 4,909,017 | A * | 3/1990 | McMahon | B65B 61/188 156/66 |
| 4,996,825 | A * | 3/1991 | Bacon | B65B 51/30 53/451 |
| 5,511,363 | A * | 4/1996 | Doede | B29C 65/18 53/552 |
| 5,852,920 | A * | 12/1998 | Linkiewicz | B29C 65/18 53/551 |
| 9,321,547 | B2 * | 4/2016 | Miyamoto | B65B 1/22 |
| 9,617,053 | B2 * | 4/2017 | Fisher | B65D 75/5827 |
| 10,076,207 | B2 * | 9/2018 | Chang | A47J 31/401 |
| 2004/0154271 | A1 * | 8/2004 | Rietjens | B65B 9/2042 53/451 |
| 2006/0162290 | A1 | 7/2006 | Kakita et al. | |
| 2012/0198799 | A1 | 8/2012 | Nishitsuji et al. | |
| 2012/0255260 | A1 | 10/2012 | Taylor | |

FOREIGN PATENT DOCUMENTS

| | | | |
|---|---|---|---|
| DE | 202015106885 | U1 | 2/2016 |
| JP | 2005-112374 | A | 4/2005 |
| JP | 2008-18997 | A | 1/2008 |
| JP | 2012-126460 | A | 7/2012 |

OTHER PUBLICATIONS

Search Report from the corresponding International Patent Application No. PCT/JP2017/008673 dated Apr. 4, 2017.

Preliminary Report on Patentability (with Written Opinion) from the corresponding International Patent Application No. PCT/JP2017/008673 dated Nov. 8, 2018.

* cited by examiner

PACKAGING MACHINE

CROSS-REFERENCES TO RELATED APPLICATIONS

This application is the U.S. National Phase of PCT International Application No. PCT/JP2017/008673 filed on Mar. 6, 2017. That application claims priority to Japanese Patent Application No. 2016-090442, filed on Apr. 28, 2016. The contents of both applications are herein incorporated by reference in their entirety.

BACKGROUND

Technical Field

The present disclosure relates to a safety device that protects a worker from a heated part of a vertical sealing unit when performing maintenance on a packaging machine.

Background Art

As a packaging machine that forms bags from a long film and simultaneously fills the bags with product, there is a bag-making and packaging machine.

The packaging machine is, as shown in the general configuration drawing of FIG. 10 for example, equipped with a hopper H into which the product is fed, a cylinder C that is connected to an open portion in the lower end of the hopper H, a former F that wraps a long film sheet FS around the cylinder C to thereby form the film sheet FS into a tube, a pair of pull-down belts PB that pull down the tubular film TF under the former F, a vertical sealing unit VS that heat-seals a vertical seam of the tubular film IF, and a horizontal sealing unit HS that forms horizontal seals in the tubular film TF and simultaneously seals the upper portion of a bag B filled with the product and the bottom portion of the next bag.

In this kind of packaging machine, when replacing the former F and/or the film sheet FS, a worker stops the machine, thereafter moves the pull-down belts PB and the vertical sealing unit VS back from the tubular film IF, then opens the vertical sealing unit VS in the direction of the arrow together with a protective cover K indicated by the dashed lines, and removes the tubular film TF and/or detaches the former F. At that time, a heated part HB of the vertical sealing unit VS becomes exposed to the worker side, so the worker can touch the heated part HB and sustain a burn injury.

BRIEF SUMMARY

Therefore, a machine is known where a cover that covers the heated part BB of the vertical sealing unit exposed to the worker side is movably provided, during operation the cover is retracted to the side of the heated part HB, and during maintenance the cover is moved over the heated part HB.

However, this kind of machine has had the problem of increased cost because it requires a sensor that detects that the vertical sealing unit VS has been opened and a drive mechanism that causes the cover to cover the heated part HB on the basis of the detection signal of the sensor.

Furthermore, when the vertical seal portion of the bag is a fin seal, a pair of sealing jaws that sandwich and heat-seal the seam of the tubular film are used as the vertical sealing unit VS, but when the vertical sealing unit is opened when performing maintenance on the sealing jaws, the aforementioned drive mechanism is activated and the sealing jaws become covered with the cover, so there has been the problem that maintenance of the sealing jaws cannot be performed unless a tool is used to detach the cover.

To address this, the medicine packaging machine disclosed in patent document 1 (JP-A No. 2012-126460) is configured in such a way that when one of a pair of sealing members moves toward the other sealing member, a cover that had covered the one sealing member is pushed by the other sealing member and retracts, and when these sealing members move away from each other, the cover that had retracted returns to its original position and covers the one sealing member, so the machine has the advantage that the aforementioned sensor and drive mechanism do not need to be provided. Moreover, the cover is automatically returned by a spring from the position in which it exposed the sealing member to the position in which it covers the sealing member, so the machine has the advantage that during maintenance the cover can be manually opened to expose the sealing member even without using a tool.

However, the technology of patent document 1 has a basic configuration different from that of a vertical sealing unit of a bag-making and packaging machine, so it has the problem that it cannot be applied as is to the vertical sealing unit of a bag-making and packaging machine. That is, the vertical sealing unit equipped with the heating belt HB of FIG. 10 does not have a member corresponding to the fixed-side sealing member, so it cannot utilize the technology of patent document 1 as is. Furthermore, although there is also a vertical sealing unit that sandwiches between a pair of sealing jaws and heat-seals the seam of the film in the same way as the technology of patent document 1, when the unit is opened the pair of sealing jaws remain stopped, so as in patent document 1, even if the worker were to try to move the cover by moving one sealing jaw toward and away from the other sealing jaw, it cannot be done.

The present disclosure has been developed in light of these kinds of issues, and it is an object thereof to provide a packaging machine equipped with a novel safety device with which a heated part of a vertical sealing unit is covered with a cover just by retracting the vertical sealing unit to a machine side portion even without using the aforementioned drive mechanism.

Furthermore, it is an object of the present disclosure to provide a novel packaging machine which, when using sealing jaws as the vertical sealing unit, also allows easy maintenance of the sealing jaws covered with the cover.

A packaging machine pertaining to the present disclosure includes: a vertical sealing unit that is provided so as to be retractable from a vertical sealing position for tubular film; a cover that covers a heated part of the vertical sealing unit; and a linkage mechanism that transmits the retracting movement of the vertical sealing unit to the cover to thereby cause the cover to move from a position in which it exposes the heated part to a position in which it covers the heated part.

The vertical sealing unit is attached, so as to be rotatable in the horizontal direction, to a machine side portion, and by rotating the unit in the horizontal direction, the unit can be retracted to the machine side portion.

Furthermore, it is preferred that the linkage mechanism be configured by a parallel linkage and that the cover be attached to a swinging end of the parallel linkage. In this case, when the parallel linkage swings, the cover translationally moves between the position in which it covers the heated part of the vertical sealing unit and the position in which it exposes the heated part.

Furthermore, it is preferred that one lever configuring the parallel linkage be equipped with a swinging end which extends further from a rotational pin that supports and allows the one lever to rotate and which swings in the opposite direction of the direction in which the cover moves. Furthermore, it is preferred that an actuating rod be coupled between the swinging end and the machine side portion and that, when the worker manually rotates the vertical sealing unit, the actuating rod transmit the rotating movement of the vertical sealing unit to the lever to thereby cause the lever to rotate. In this case, the cover coupled to the parallel linkage is moved by the swinging of the parallel linkage to cover the heated part of the vertical sealing unit. Because of this, there can be provided a packaging machine that is safe, even when the vertical sealing unit is opened from the machine body and the heated part of the vertical sealing unit is exposed to the worker side, because of the cover that covers the heated part. Moreover, there can be provided a machine that is inexpensive because a sensor and/or a drive mechanism is not used to move the cover.

Furthermore, it is preferred that the cover be coupled via a hinge to the linkage mechanism and that the hinge be switchable between a posture in which it covers the heated part with the cover and a posture in which it flips up the cover from there to expose the heated part. In this case, even if the heated part of the vertical sealing unit is covered with the cover during maintenance, the cover can be manually flipped up to expose the heated part, so sealing defects can be prevented by adjusting the alignment of the heated part and/or cleaning the heated part.

Furthermore, it is preferred that the hinge be equipped with a spring that returns the cover flipped up from the heated part to its original position. Because of this, accidents caused by forgetting to close the cover after maintenance can be prevented.

Furthermore, the vertical sealing unit can be equipped with a pair of sealing jaws that move toward and away from each other and can sandwich between the sealing jaws and heat-seal the seam of the tubular film. However, the vertical sealing unit used in the present disclosure is not limited to this and can, for example, be a vertical sealing unit that presses a circulating heating belt against and heat-seals the seam of the tubular film while continuously pulling down the tubular film.

In a case where the vertical sealing unit is equipped with the pair of sealing jaws, it is preferred that a driver that causes the sealing jaws to move toward and away from each other be disposed on one side of the sealing jaws and that the linkage mechanism be disposed on the other side.

Because of this, the driver and the linkage mechanism are disposed apart from each other on both sides of the pair of sealing jaws in the vertical sealing unit, so the present advancement can also be easily incorporated into an existing vertical sealing unit.

According to the present advancement, when the worker moves the vertical sealing unit to the retracted position, in conjunction with that movement the cover covers the heated part of the vertical sealing unit, so there can be provided a packaging machine that is safe when replacing the former and/or the film. Furthermore, there can be provided a safety device that is inexpensive because the machine does not require a sensor and/or a drive mechanism as in the conventional machine.

Moreover, the cover that covers the heated part is coupled via the hinge to the linkage mechanism, so by manually flipping up the cover to expose the heated part during maintenance, the alignment of the heated part can be adjusted, and the heated part can be cleaned, in that state. Consequently, it is not necessary to use a tool to detach the cover, so workability is improved and, because of that, problems in the sealing by the vertical sealing unit can be prevented.

DETAILED DESCRIPTION OF EMBODIMENT

A packaging machine pertaining to an embodiment of the present disclosure will be described below with reference to the drawings. It will be noted that the embodiment described below is not intended to limit the technical scope of the present disclosure.

Figure 1:
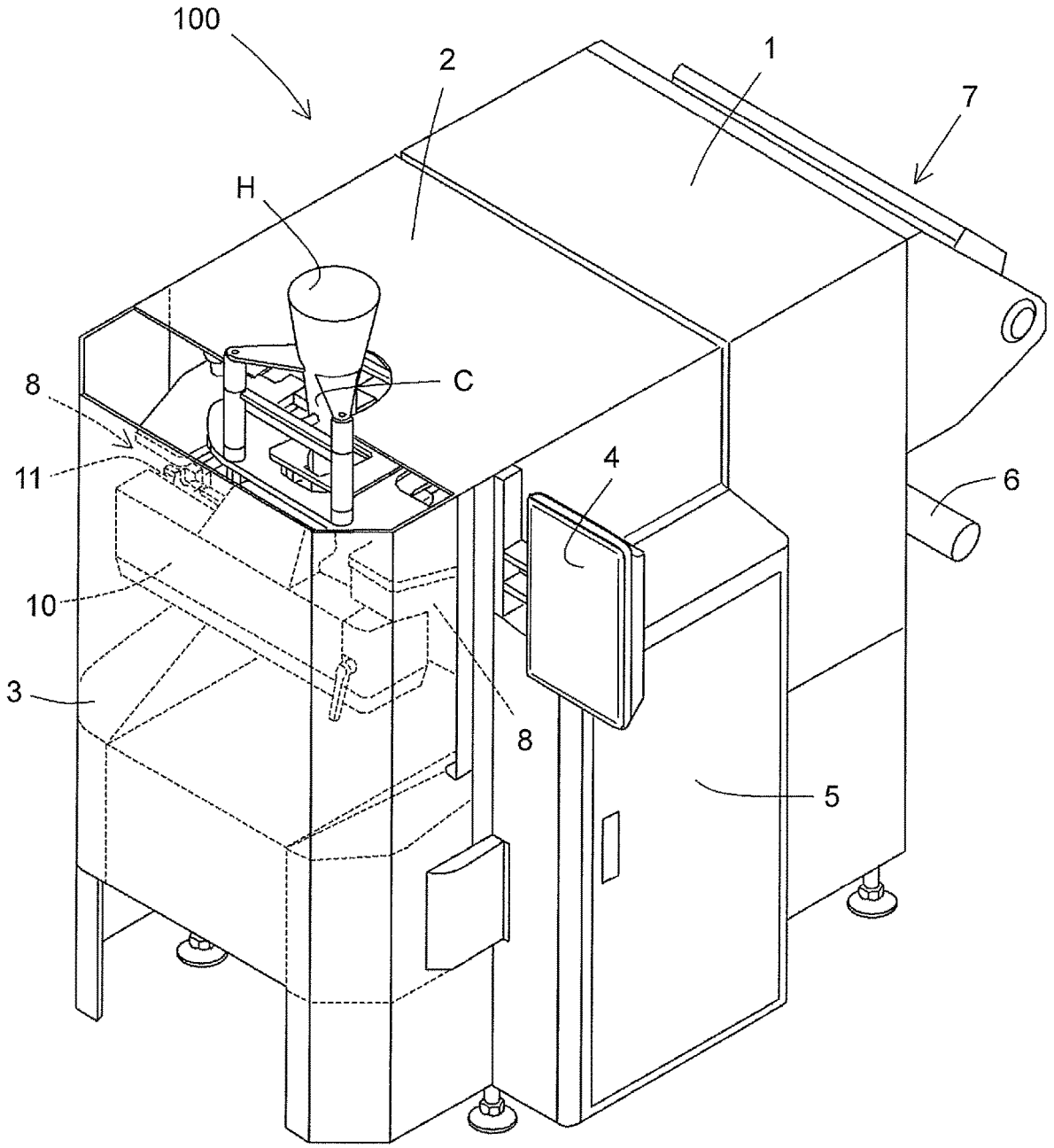
FIG. 1 is an overall perspective view of a packaging machine pertaining to an embodiment of the present disclosure.

FIG. 1 shows an external perspective view of the embodiment of the packaging machine pertaining to the present disclosure. In this drawing, a packaging machine 100 is equipped with a film roll housing section 1 in its rear portion, a bag-making and packaging section 2 in its front portion, a cover member 3 attached to the front surface side of the bag-making and packaging section 2, an operation unit 4 equipped with a touch panel of a machine side portion 8, and an electrical control box 5 that controls a switchboard and the machine overall.

The film roll housing section 1 is equipped with a support mechanism 6 that supports a film roll, a splicer 7 which, when the film wound in the film roll runs out, splices the leading end portion of the subsequent film to the trailing end portion of the preceding film, and a dancer roller not shown in the drawings that controls abrupt fluctuations in tension during film conveyance.

Figure 10:
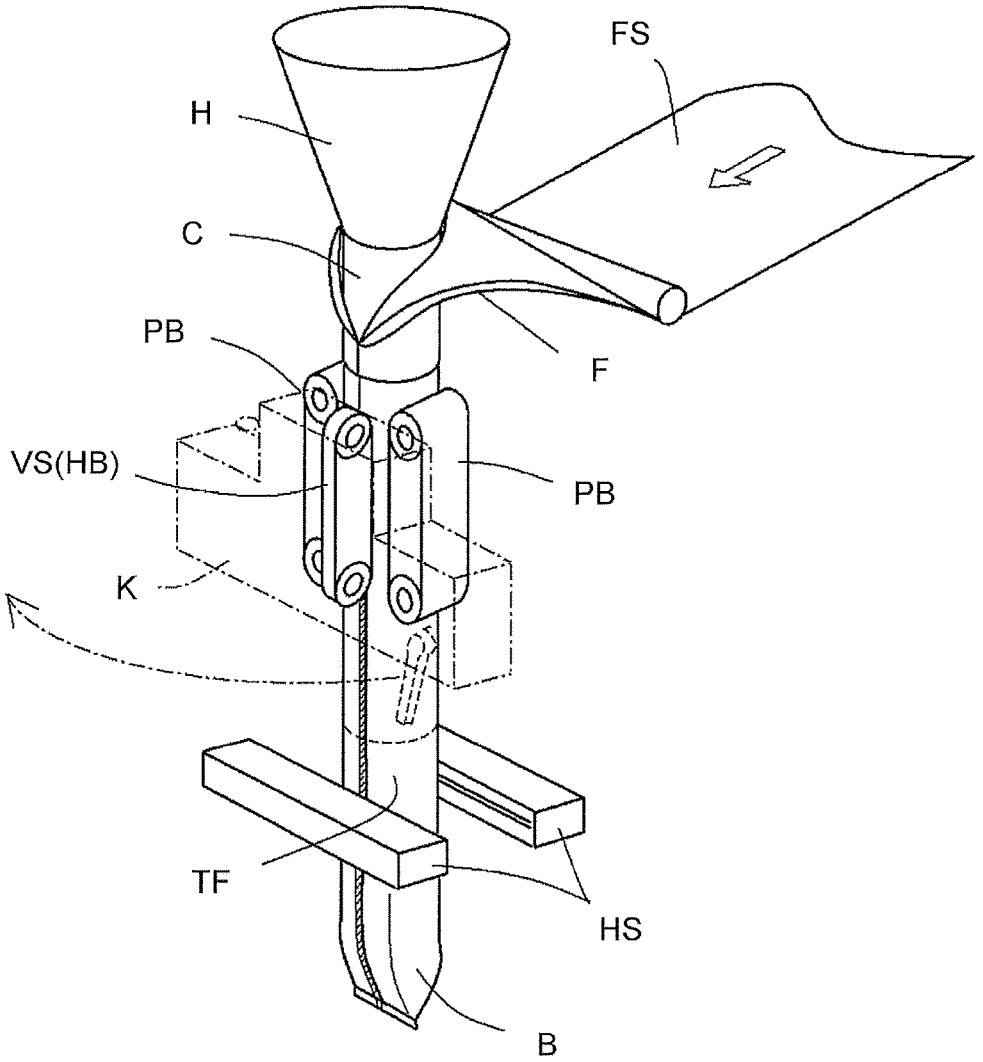
Prior Art F I G. 1 0
FIG. 10 is a configurable explanatory drawing for describing the basic configuration of a conventional packaging machine.

Housed in the bag-making and packaging section 2 are the basic constituent elements of FIG. 10. That is, the bag-making and packaging section 2 is equipped with a hopper H into which product is fed, a cylinder C that is connected to an open portion in the lower end of the hopper H, a former F that wraps a film sheet around the cylinder C to thereby form the film sheet into a tube (see FIG. 10), a right and left pair of pull-down belts PB that pull down the tubular film under the former F (see FIG. 10), a vertical sealing unit 10 that heat-seals the seam of both vertical direction sides of the tubular film, and the horizontal sealing unit HS of FIG. 10 that forms horizontal seals in the tubular film under the vertical sealing unit 10 and simultaneously horizontally seals and cuts the upper portion of the bag filled with the product and the bottom portion of the next bag. Furthermore, the film sheet paid out via the aforementioned dancer roller is guided to the former F of FIG. 10, and there it is formed into the tubular film.

Figure 2:
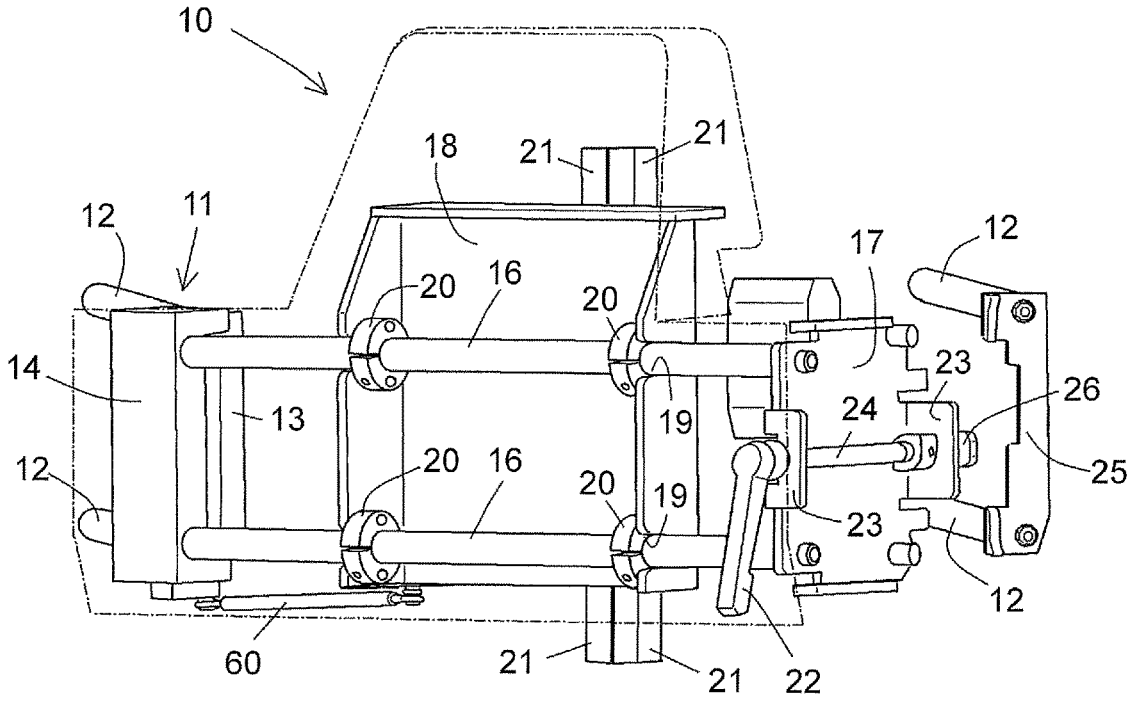
FIG. 2 is a perspective view from the front side showing a state in which a vertical sealing unit of the packaging machine has been slightly opened.
Figure 3:
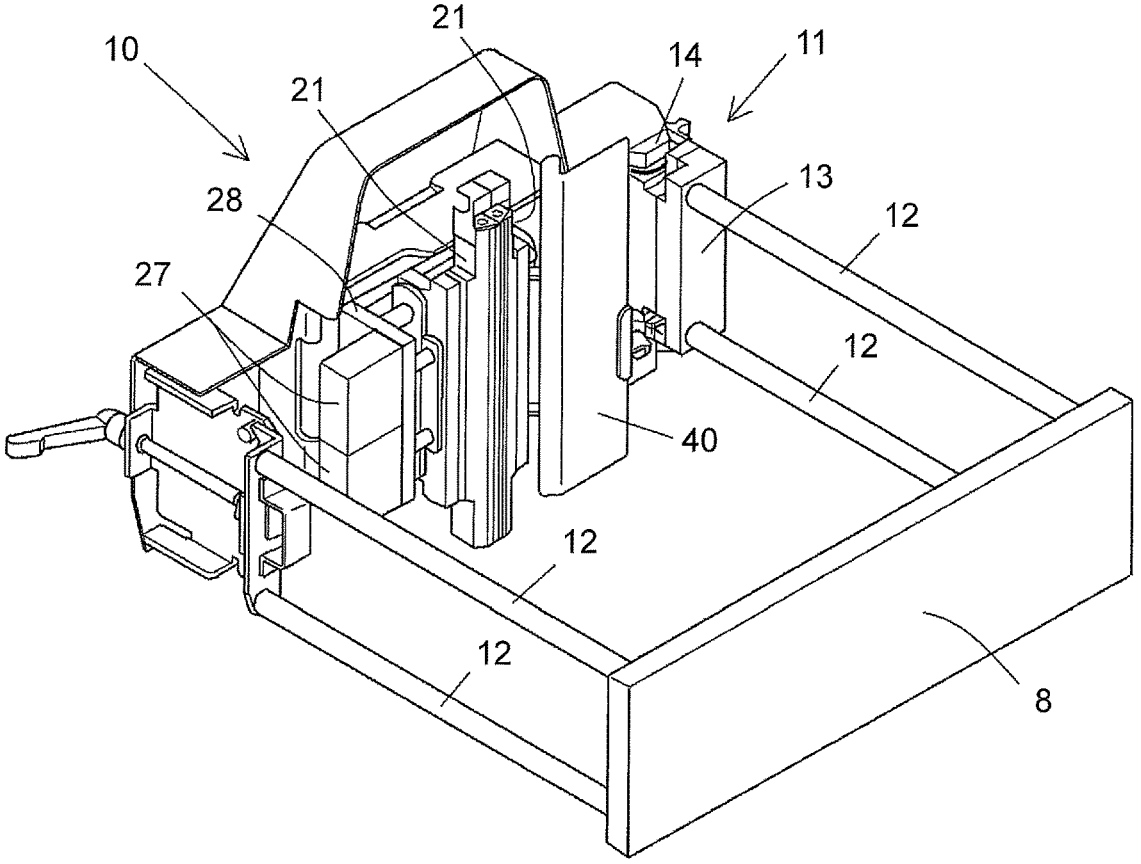
FIG. 3 is an external perspective view of the vertical sealing unit of FIG. 2 as seen from the machine body side.
Figure 4:
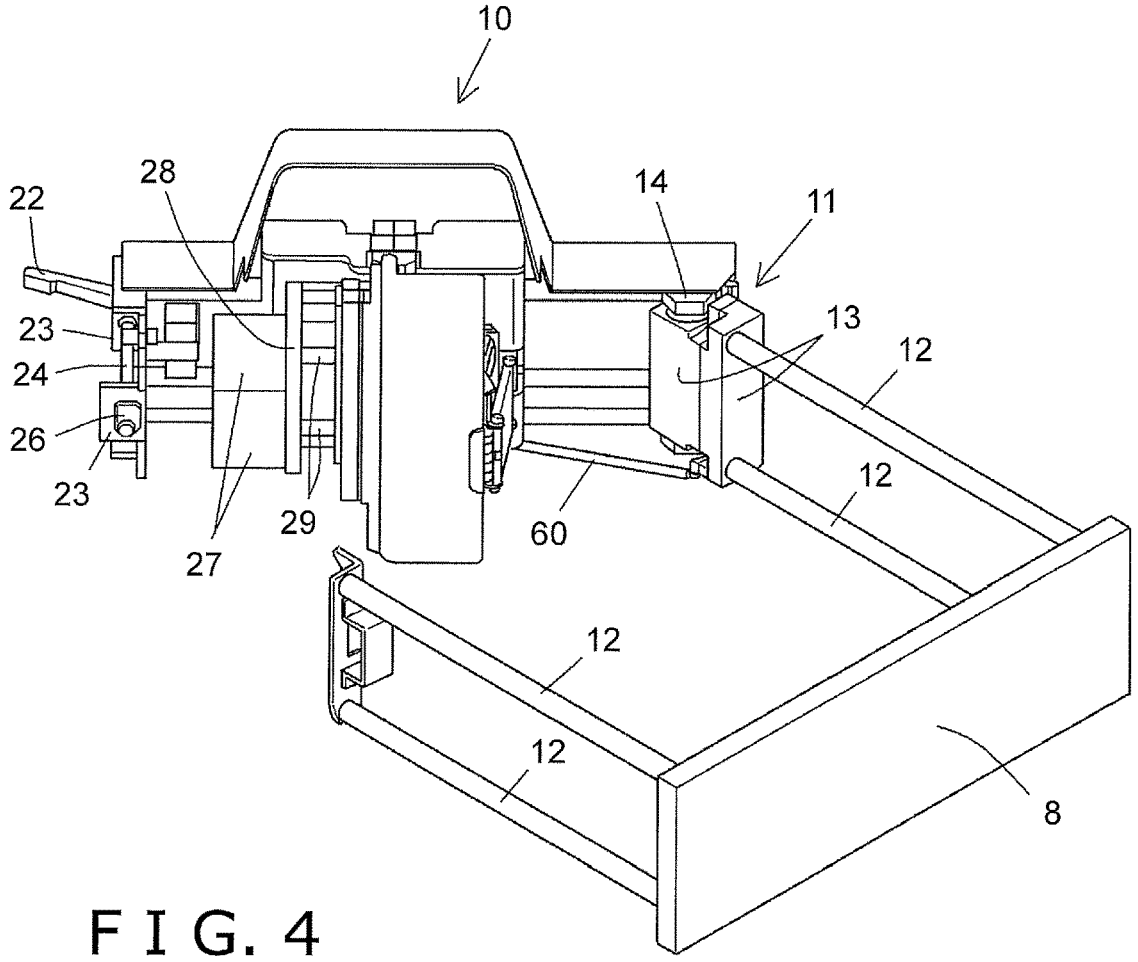
FIG. 4 is an external perspective view showing a state in which the vertical sealing unit of FIG. 3 has been opened 45 degrees.

FIG. 2 is a perspective view, as seen from the front side, showing a state when the right end of the vertical sealing unit 10 has been slightly opened from the machine body; FIG. 3 is an external perspective view, as seen from the machine side, showing a state when the vertical sealing unit 10 has been closed to the machine body; and FIG. 4 is an external perspective view, as seen from the machine side, showing a state when the vertical sealing unit 10 has been further opened 45 degrees.

In these drawings the vertical sealing unit 10 is attached, so as to be rotatable in a horizontal plane, via a hinge 11 to the machine side portion 8 of FIG. 1. The hinge 11 is disposed on the left side of the page in FIG. 2 and on the right side of the page in FIG. 3 and FIG. 4, but there are also cases where the hinge 11 is disposed on the opposite sides.

The hinge 11 is configured by a fixed block 13 that is attached to the machine side portion 8, a movable block 14 that is attached to the vertical sealing unit 10, and a vertical rotational pin 15 (see FIG. 5 to FIG. 7) that rotatably intercouples the blocks 13 and 14. The fixed block 13 is secured to distal end portions of parallel shafts 12 that serve as a machine frame of the machine side portion 8. Consequently, the vertical sealing unit 10 rotates in the horizontal direction about the rotational pin 15.

In FIG. 2, parallel support shafts 16 that extend in the horizontal direction are secured to the movable block 14 on the vertical sealing unit 10 side, and a single plate 17 is screwed to the right-side end portions of the support shafts 16. Because of this, the upper and lower support shafts 16 are integrated by the plate 17. Furthermore, a mounting plate 18 that is U-shaped as seen in a plan view is disposed in the middle of the support shafts 16, cutouts 19 into which the support shafts 16 fit from the horizontal direction are formed in both side surfaces of the mounting plate 18, and slit collars 20 through which the support shafts 16 are passed are screwed to peripheral edges of the cutouts 19.

Furthermore, a pair of sealing jaws 21 are disposed in the vertical direction on the reverse side of the mounting plate 18, and the position at which the mounting plate 18 is attached to the parallel shafts 16 is adjusted in such a way that meshing surfaces of the sealing jaws 21 are aligned with mating surfaces of the tubular film. That is, the right and left direction position of the mounting plate 18 is adjusted by loosening the slit collars 20, and when the position is decided, the slit collars 20 are tightened to secure them to the support shafts 16.

Furthermore, bent portions 23 for attaching a lever handle 22 are formed in both front and rear direction side surfaces of the right-side plate 17, and a rotating shaft 24 of the lever handle 22 is passed through the bent portions 23. Furthermore, a tongue piece 26 that catches on a plate 25 of the machine side portion 8 is attached to the distal end portion of the rotating shaft 24; when the lever handle 22 pointing in the vertical direction in FIG. 2 is turned in the horizontal direction, the tongue piece 24 rotates and comes away from the plate 25, and when the lever handle 22 is pulled forward in that state, the vertical sealing unit 10 can be opened forward about the hinge 11.

It will be noted that the plate 25 on which the tongue piece 26 catches vertically bridges the distal end portions of the parallel shafts 12 disposed in the machine side portion 8 on the opposite side of the hinge 11.

Provided on the reverse side (machine side) of the mounting plate 18 in FIG. 3 and FIG. 4 are the pair of sealing jaws 21, air cylinders 27 serving as drivers that move one sealing jaw 21 toward and away from the other sealing jaw 21; and a support block 28 to which the air cylinders 27 are secured.

Figure 5:
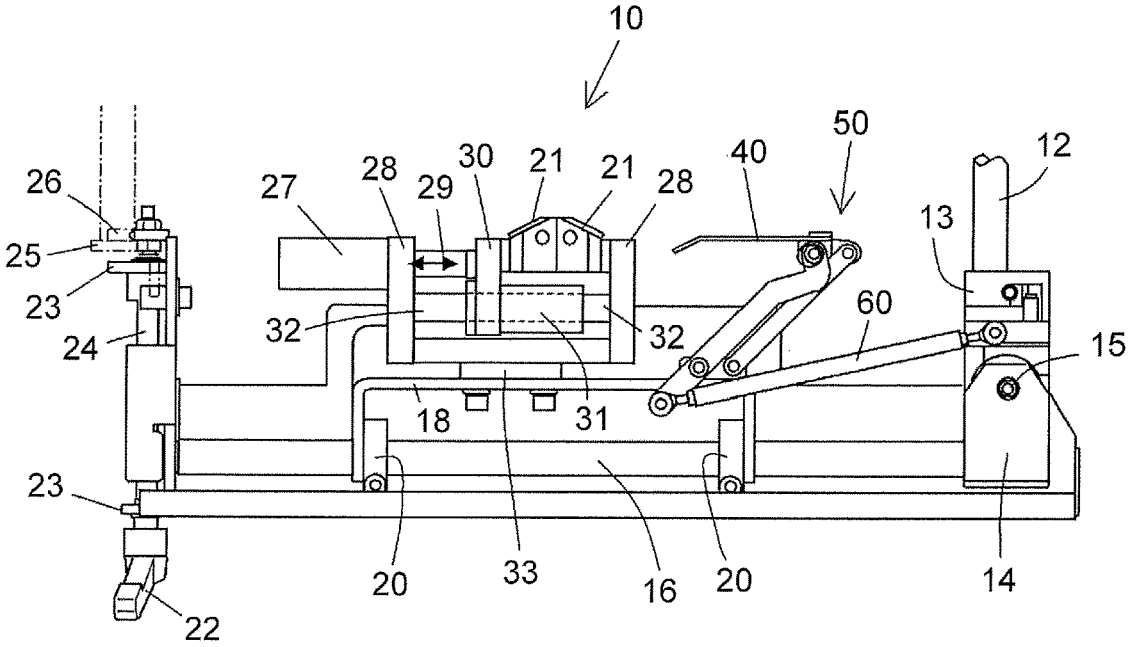
FIG. 5 is a bottom view of the vertical sealing unit of FIG. 3 as seen from its bottom side.
Figure 6:
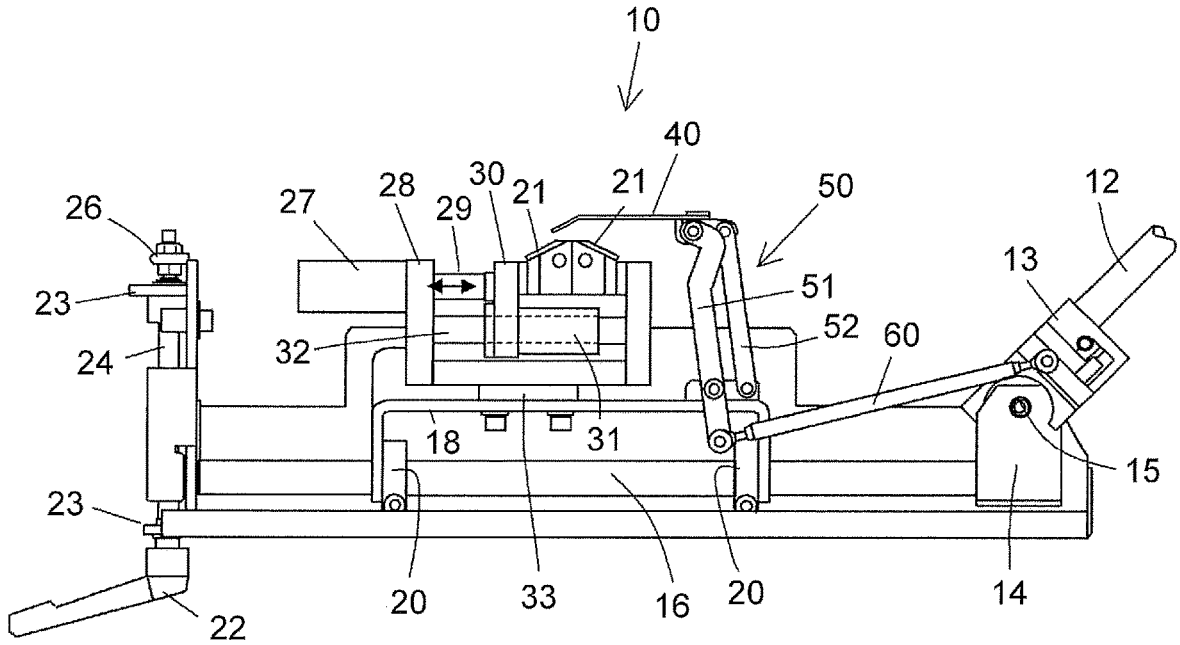
FIG. 6 is a bottom view showing a state in which the vertical sealing unit of FIG. 5 has been opened 45 degrees.
Figure 7:
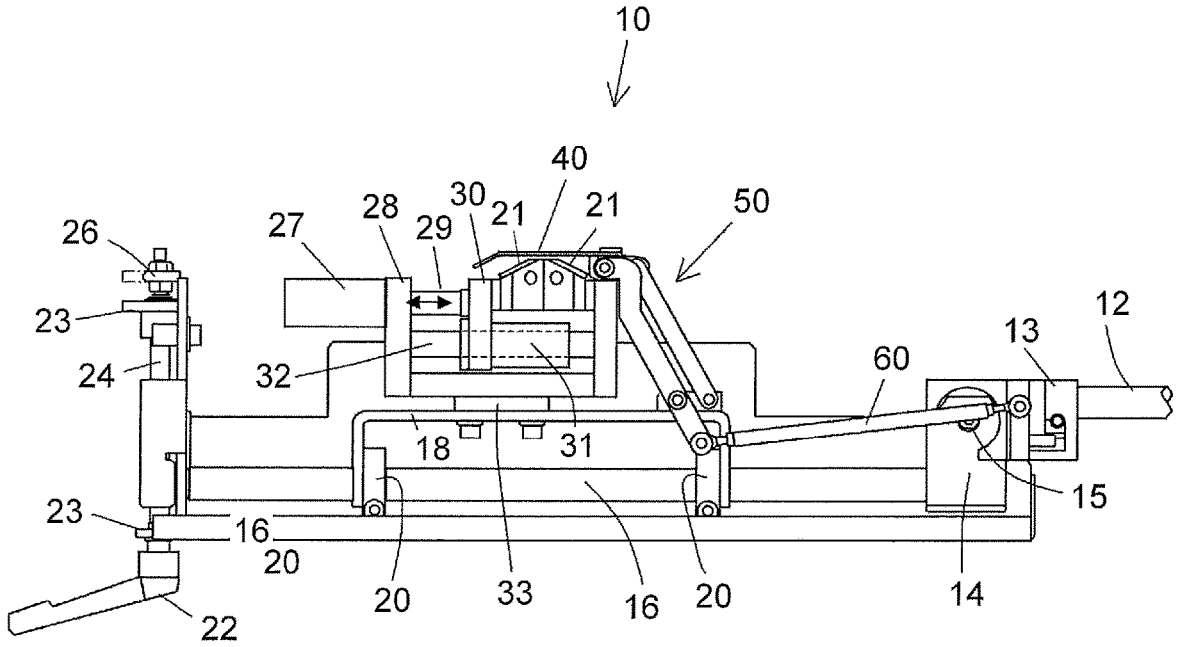
FIG. 7 is a bottom view showing a state in which the vertical sealing unit of FIG. 5 has been opened 90 degrees.

FIG. 5 is a bottom view of the vertical sealing unit 10, as seen from its bottom, when the vertical sealing unit 10 is closed to the machine body; FIG. 6 is a bottom view showing a state in which the vertical sealing unit 10 has been opened 45 degrees with respect to the parallel shafts 12; and FIG. 7 is a bottom view showing a state in which the unit 10 has been further opened to 90 degrees.

In these drawings, the support block 28 for the air cylinders 27 has a U-shape as seen in a plan view; the air cylinders 27 serving as drivers are attached to one side surface of the block 28, and one sealing jaw 21 is attached via a movable block 30 to distal end portions of piston rods 29 of the air cylinders 27. Furthermore, the other sealing jaw 21 that meshes with that sealing jaw 21 is secured to the other side surface of the support block 28.

A linear bush 31 is attached, parallel to the piston rods 29, to the lower portion of the movable block 30, and a guide rod 32 is slidably inserted through the bush 31. Furthermore, both end portions of the guide rod 32 are secured to side surfaces on both sides of the support block 28. Additionally, when the piston rods 29 of the air cylinders 27 move in the directions of the arrows, the movable block 30 is guided by the guide rod 32 and reciprocally moves. Consequently, when the piston rods 29 of the air cylinders 27 move backward, the pair of sealing jaws 21 open, and when the piston rods 29 move forward, the sealing jaws 21 close and mesh with a predetermined pressure. It will be noted that the support block 28 is secured to the reverse surface of the mounting plate 18 via a rectangular block 33.

Provided in the vertical sealing unit 10 in FIG. 5 to FIG. 8 are a cover 40 that covers the pair of sealing jaws 21 (a heated part) that become heated, a linkage mechanism 50 that translationally moves the cover 40 between a position in which it covers the heated part and a position in which it exposes the heated part, and an actuating rod 60 that rotates the linkage mechanism 50 in conjunction with the rotation of the vertical sealing unit 10.

Figure 8:
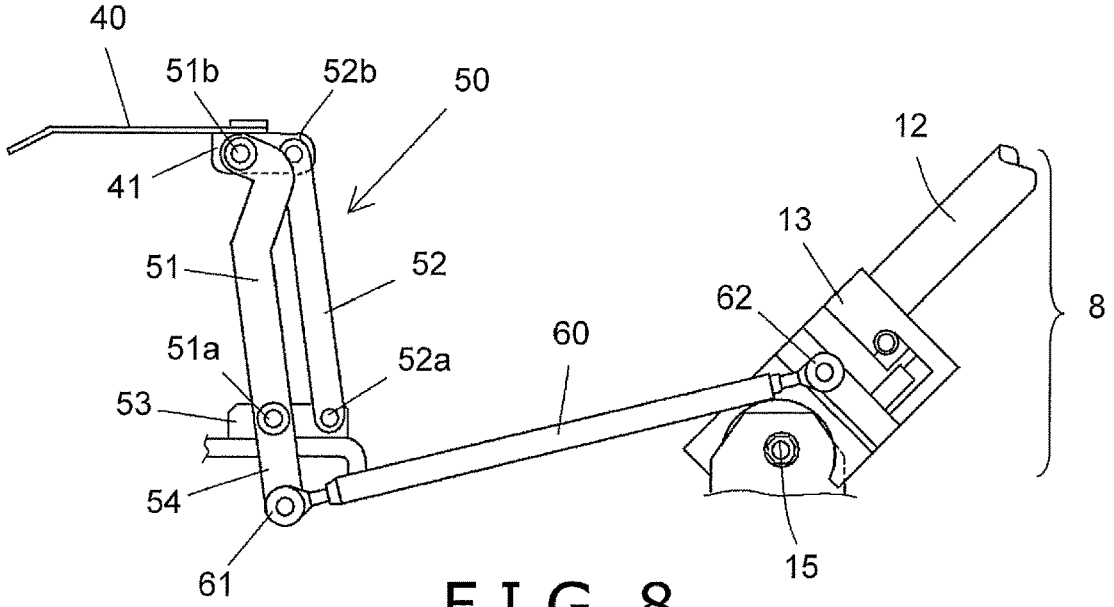
FIG. 8 is an enlarged view of a cover and a linkage mechanism.
Figure 9:
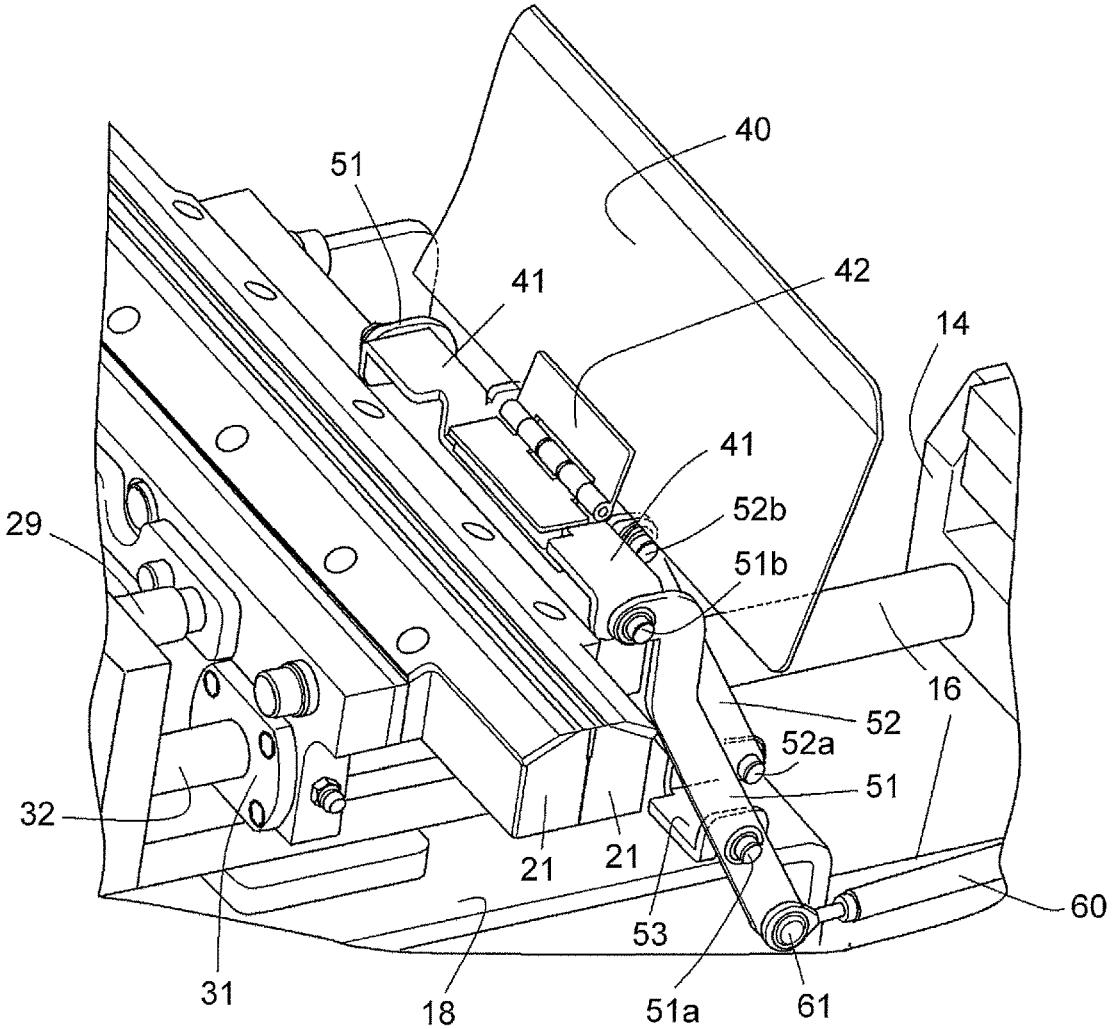
FIG. 9 is an enlarged perspective view showing a state in which the cover is attached via a hinge to the linkage mechanism.

FIG. 8 shows an enlarged view of the cover 40 and the linkage mechanism 50, and FIG. 9 shows a partial perspective view in a state in which the cover 40 attached via a hinge 42 to the linkage mechanism 50 has been flipped up in a direction away from the sealing jaws 21. In these drawings, the cover 40 is formed of a plate with a size that completely covers the sealing jaws 21 that become heated. The linkage mechanism 50 is what is called a quadric-chain parallel linkage, with fixed-side rotational pins 51*a* and 52*a* of levers 51 and 52 being rotatably attached to brackets 53 secured to the mounting plate 18 and with swinging-side rotational pins 51*b* and 52*b* of the levers 51 and 52 being likewise rotatably attached to a bracket 41 attached to the reverse surface side of the cover 40.

Furthermore, one lever 51 is equipped with a swinging end 54 that extends beyond the fixed-side rotational pin 51*a* toward the opposite side and swings in the opposite direction of the cover 40, and one end of the actuating rod 60 is attached via a rod end bearing 61 to the swinging end 54. The other end portion of the actuating rod 60 is likewise attached via a rod end bearing 62 to the fixed block 13 of the machine side portion 8. Consequently, when the vertical sealing unit 10 rotates in the horizontal direction so that the actuating rod 60 is pulled in the opposite direction, the swinging end 54 of the lever 51 rotates in the counter-clockwise direction, so the cover 40 moves leftward and moves toward a position in which it covers the pair of sealing jaws 21.

Consequently, when the vertical sealing unit 10 is in the vertical sealing position, that is, in a state in which the vertical sealing unit 10 is closed to the machine body side, the cover 40 is retracted to the side of the sealing jaws 21 as shown in FIG. 5. From this state, when the worker turns the lever handle 22 to unlock it from the plate 25 and then pulls the lever handle 22 forward to rotate the vertical sealing unit 10 toward the machine side portion 8, in conjunction with that movement the cover 40 that had been on the side of the sealing jaws 21 is pulled by the actuating rod 60 and moves toward the position in which it covers the sealing jaws 21 as shown in FIG. 6. Then, as shown in FIG. 7, when the worker opens the vertical sealing unit 10 90 degrees, the cover 40 reaches a position in which it completely covers the heated part of the sealing jaws 21. The length of each link of the linkage mechanism 50 as well as the length of the actuating rod 60 and the attachment positions thereof are decided in such a way that this movement and positional relationship are obtained.

In FIG. 9, the bracket 41 coupled to each set of the two levers 51 and 52 disposed on the right and left sides thereof is disposed on the reverse surface side of the cover 40, and the cover 40 is attached via the hinge 42 to the bracket 41. Consequently, the cover 40 is coupled via the hinge 42 and the bracket 41 to the swinging end of the linkage mechanism 50, so even if during maintenance the cover 40 is in the position in which it covers the sealing jaws 21, the sealing jaws 21 can be exposed by manually flipping up the cover 40. Because of this, sealing defects can be prevented by adjusting the alignment between the pair of sealing jaws 21 and/or cleaning the meshing surfaces of the sealing jaws 21 without detaching the cover 40.

Furthermore, the hinge 42 is equipped with a return spring not shown in the drawings. Because of this, when maintenance is finished, the cover 40 is automatically returned by the spring to the position in which it covers the sealing jaws 21, so accidents caused by forgetting to close the flipped-up cover 40 can be prevented.

Furthermore, the linkage mechanism 50 is provided on the side where the air cylinders 27 are not disposed, so there is nothing to hinder the translational movement of the cover 40, and even when the vertical sealing unit 10 is set in the vertical sealing position in the machine body, the linkage mechanism 50 does not interfere with the tubular film TF. Consequently, it becomes easy to incorporate a safety device configured from the cover 40, the linkage mechanism 50, and the actuating rod 60 into an existing vertical sealing unit.

An embodiment of the present disclosure has been described above, but the present disclosure is not limited to this and can also employ other configurations. For example, in the embodiment, the vertical sealing unit is configured to be rotated in the horizontal direction, but the vertical sealing unit can also be configured to be translationally moved via a linkage. Furthermore, the vertical sealing unit employs a system where the seam of the tubular film is sandwiched between and sealed by the pair of sealing jaws 21, but instead of this the vertical sealing unit can also be a vertical sealing unit equipped with a circulating type of heating belt such as shown in FIG. 10. In this case, the air cylinders that cause the pair of sealing jaws to move toward and away from each other become unnecessary, so the vertical sealing unit 10 can be given a simple configuration. Furthermore, when using the heating belt, the inside heater part around which the heating belt travels is also exposed to the worker side, so the cover is configured as a dome or a tunnel rather than a plate so that it widely covers the heating belt while following a circular arc.

REFERENCE SIGNS LIST

TF Tubular film
8 Machine Side Portion
10 Vertical Sealing Unit
21 Sealing Jaws (Heated Part)
27 Air Cylinders (Drivers)
40 Cover
42 Hinge
50 Linkage Mechanism
51 One Lever
51*a* Rotational Pin
54 Swinging End
60 Actuating Rod
100 Packaging Machine

The invention claimed is:

1. A packaging machine comprising:
a vertical sealing unit that is provided so as to be retractable from a vertical sealing position for tubular film;
a movable cover that covers a heated part of the vertical sealing unit; and
a linkage mechanism that transmits a retracting movement of the vertical sealing unit to the cover to thereby cause the cover to move from a position in which it exposes the heated part to a position in which it covers the heated part.

2. The packaging machine according to claim 1, wherein
the vertical sealing unit is attached, so as to be rotatable in a horizontal direction, to a machine side portion,
the linkage mechanism is configured by a parallel linkage, and
the cover is attached to a swinging end of the parallel linkage.

3. The packaging machine according to claim 2, wherein
one lever configuring the parallel linkage is equipped with a swinging end which extends further from a rotational pin that allows the lever to rotate and whitch swings in the opposite direction of the cover,
an actuating rod is coupled between the swinging end and the machine side portion, and,
when the vertical sealing unit rotates toward the machine side portion, the actuating rod transmits a rotating movement of the vertical sealing unit to the lever to thereby cause the lever to rotate.

4. The packaging machine according to claim 1, wherein
the cover is coupled via a hinge to the linkage mechanism, and
the hinge is switchable between a posture in which the cover covers the heated part and a posture in which it flips up the cover from there to expose the heated part.

5. The packaging machine according to claim 4, wherein the hinge is equipped with a spring that returns the cover flipped up from the heated part to its original position.

6. The packaging machine according to claim 1, wherein
the vertical sealing unit is equipped with a pair of sealing jaws that move toward and away from each other,
a driver that causes the sealing jaws to move toward and away from each other is disposed on one side of the sealing jaws, and the linkage mechanism is disposed on the other side of the sealing jaws.

* * * * *